US005690170A

United States Patent [19]

Hailey et al.

[11] Patent Number: 5,690,170

[45] Date of Patent: Nov. 25, 1997

[54] HYDRAULIC CUTTING OVERSHOT

[76] Inventors: Charles D. Hailey, 11628 Burning Oaks, Oklahoma City, Okla. 73150; Wayne M. Biart, 12022 Knob Crest, Houston, Tex. 77070

[21] Appl. No.: 605,370

[22] Filed: Feb. 22, 1996

[51] Int. Cl.[6] ..... E21B 31/16

[52] U.S. Cl. ..... 166/55; 166/55.3; 294/86.34

[58] Field of Search ..... 166/55.1, 55.3, 166/98, 99, 55; 294/86.34, 86.3, 86.14, 86.15

[56] References Cited

U.S. PATENT DOCUMENTS

| | | | |
|---|---|---|---|
| 1,747,513 | 2/1930 | Kammerdiner | 166/55.3 |
| 1,795,322 | 3/1931 | Triplett | 294/86.3 |
| 2,167,445 | 7/1939 | Brown | 166/55.1 |
| 3,031,015 | 4/1962 | De Cordova | 294/86.34 |
| 3,174,548 | 3/1965 | Webb | 294/86.34 |
| 4,099,561 | 7/1978 | Nelson | 166/55.1 |
| 4,160,478 | 7/1979 | Calhoun et al. | 166/55.1 |
| 4,662,436 | 5/1987 | Parra et al. | 166/55.6 |
| 4,883,118 | 11/1989 | Preston | 166/55.3 |

*Primary Examiner*—Hoang C. Dang

*Attorney, Agent, or Firm*—Dougherty, Hessin, Beavers & Gilbert

[57] ABSTRACT

An overshot cutter for suspension from coiled tubing that includes an elongate housing which includes a drive piston at the upper end with adjustable axial passage, an inner barrel there-below, and a cutter piston extending a collet cutter next below and finally a restrictor block; whereby the housing lower end is positioned down over a fish for hydraulic release of the drive piston to drive the inner barrel and cutter piston downward thereby to close the collet cutter within the restrictor block to cut the tubing below the fish.

9 Claims, 2 Drawing Sheets

HYDRAULIC CUTTING OVERSHOT

BACKGROUND OF THE INVENTION

1. Field of the Invention

The present invention relates to a type of overshot with a shear cutting capability and, more particularly, but not by way of limitation, it relates to an improved overshot that is particularly adapted for use with coiled tubing and is capable of cutting off a damaged fish portion for removal up hole thereby to enable a more clearly positioned extraction effort.

2. Description of the Prior Art

The prior art includes various types of fishing tools that are utilized primarily with drill pipe operations. Thus, there was the basic overshot, a cylindrical ball shaped tool that telescoped over the fish so that an internal slip arrangement could be activated to grasp the outside of the fish to insert a tightening pull thereon. There were also spear devices which were passed inside of the fish to grasp its inner wall with expanding slips that were set or released by pipe rotation. One of the oldest types of fishing tool was the tapered tap wherein the tap was run into the fish and rotated until sufficient thread cut had been made to provide a firm lifting hold. There were also inside and outside cutters actuated by surface manipulation of the drill pipe to cut the fish portion of the drill pipe for removal from the borehole. Such prior fishing tools were primarily born of expedience in dealing with stuck drill pipe and the later advent of coiled tubing usage necessitates other methods of dealing with the problem.

SUMMARY OF THE INVENTION

The present invention relates to an improved type of fishing tool, namely an overshot cutter, which may be utilized in coiled tubing operations. The fishing tool may be suspended from coiled tubing and hydraulically operated by pressure change, and the tool consists of a cylindrical body that is coupled to a tubing connector having a central bore with selected burst disk communicating to the annulus. The tubular body contains a drive piston slidable therein and retained at an uppermost position by means of a shear pin of selected strength, and an inner barrel is slidably positioned in the tubular body beneath the piston. Beneath the inner barrel, and slidable within the tubular housing, is a cutter piston having contractile collet cutter structure at the lower end for coaction with a closure orifice during downward movement of the inner piston assemblies.

Therefore, it is an object of the present invention to provide a fishing tool that is operable to close over a fish and cut off the damaged tubing portion in response to differential hydraulic pressure.

It is also an object of the present invention to provide a device for enveloping and cutting off a fish for subsequent engagement of the cleanly cut coil tubing thereby to enable extraction or re-connection to the tubing.

It is yet further an object of the present invention to provide more effective fishing tool operation with coiled tubing drilling assemblies.

Finally, it is an object of the present invention to provide a relatively simple overshot device that is hydraulically actuatable to cut off tubing below the fish.

Other objects and advantages of the invention will be evident from the following detailed description when read in conjunction with the accompanying drawings which illustrate the invention.

DETAILED DESCRIPTION OF THE INVENTION

Figure 1:
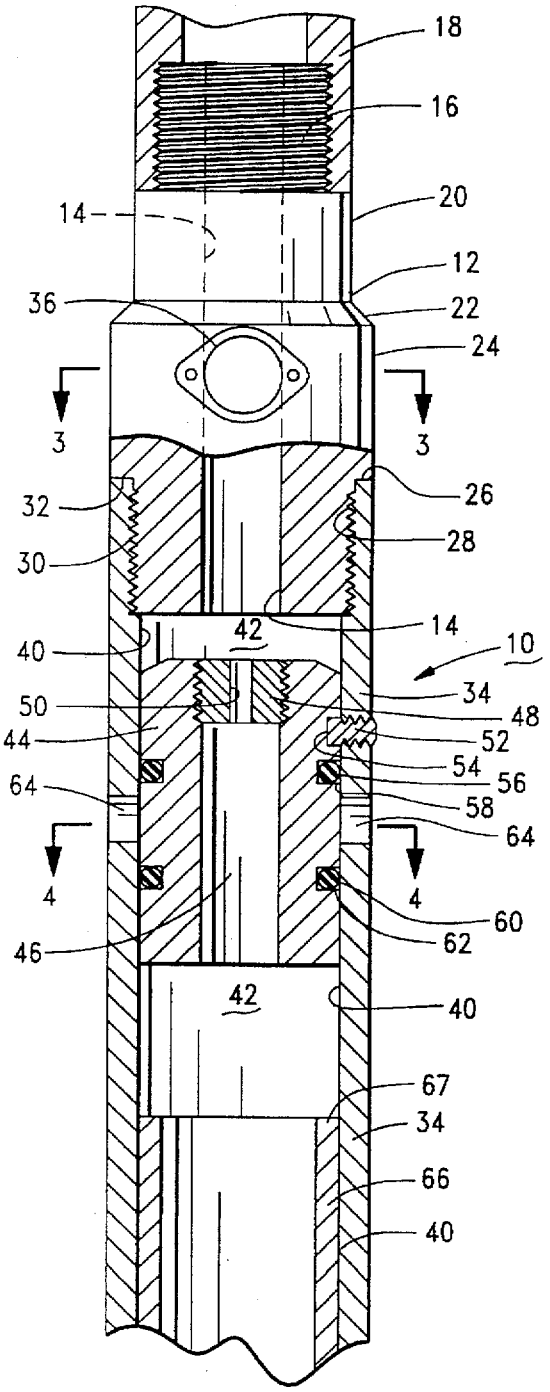
FIG. 1 is a vertical section of the upper portion of the cutting overshot.
Figure 2:
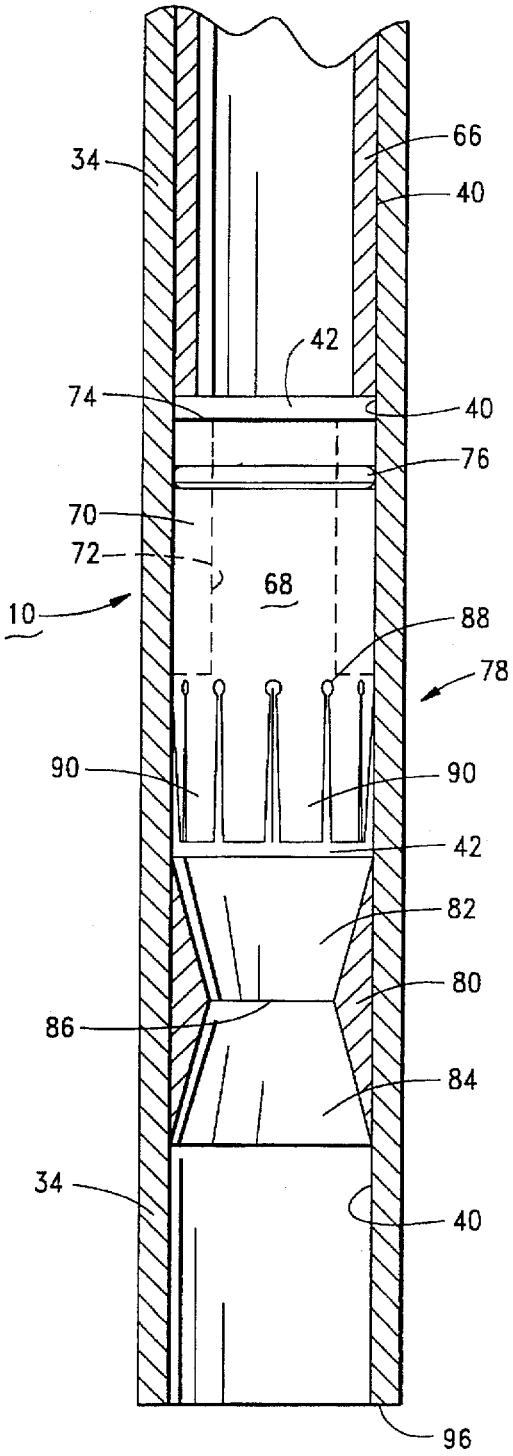
FIG. 2 is a vertical section of the lower portion of the cutting overshot.

FIGS. 1 and 2 show the upper and lower halves, respectively, of an overshot cutter 10. Referring to FIG. 1, a top sub 12 having an annular bore 14 is connected by means of threads 16 to a tubing coupling 18. The top sub 12 is formed with a top portion 20 having the same outside diameter as tubing coupling 18 which extends down through annular shoulder 22 to a lower section 24 having an outside diameter that is the same as that of overshot cutter 10.

Figure 3:
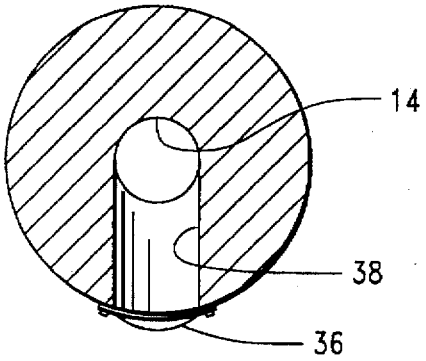
FIG. 3 is a section taken along lines 3—3 of FIG. 1.

The lower end of top sub 12 is formed with an annular shoulder 26 to form threads 28 which matingly engage with threads 30 and annular end 32 of a cylindrical housing or body 34 of the overshot cutter 10. A burst disk 36 of preselected burst strength is sealingly secured over a radial bore 38 in communication with longitudinal bore 14 (see FIG. 3). The burst disk 36 having a burst strength of, e.g. 5000 psi, provides a check for the over-pressure situation.

Figure 4:
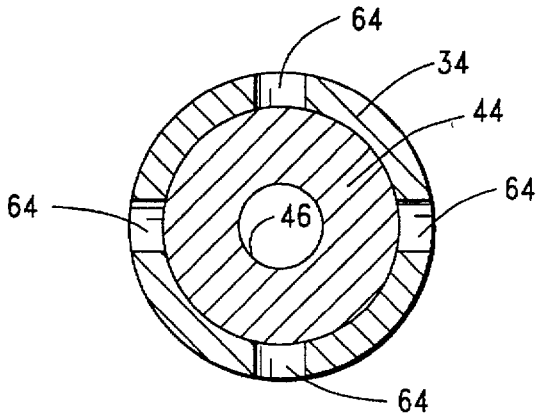
FIG. 4 is a section taken along lines 4—4 of FIG. 1.

The cylindrical housing 34 extends the entire length of overshot cutter 10 and includes a uniform diameter inside surface 40 extending therethrough and defining a slideway 42. The upper portion of slideway 42 includes a drive piston 44 having an axial bore 46 which includes a threaded orifice plug 48 at the upper end. The orifice plug 48 contains an axial orifice 50 which may be any of various diameters as the orifice plug 48 is replaced. The drive piston 44 is retained at top operative position by one or more shear pins 52 which are threadedly received through the cylindrical housing 34 into a plug recess 54. The shear pins 52 may be deployed at one or more positions to accommodate any of a number of shear strengths. An O-ring 56 is seated in a groove 58 in the upper half of drive piston 44, and an O-ring 60 is seated in groove 62 in the lower half of drive piston 44. A plurality of circulation ports, e.g., four such ports 64 are formed in the cylindrical housing 34, see the section of FIG. 4, between sealing rings 56 and 60.

A slidable inner barrel 66 having annular end 67 is then disposed in slideway 42 beneath the drive piston 44 at a spacing of several inches. The length of inner barrel 66, and the associated length of cylinder housing 34, may vary in accordance with the length of the fish that is to be cut and extracted. This dimension may vary with each fishing job, and in most cases the selection and arriving at proper lengths will be a trial and error proposition. In some cases, a considerably long length of overshot may be required in order to cut and remove all damaged or fish material.

Referring now to FIG. 2, immediately below the inner barrel 66 is a cutter piston 68 that also rides in the slideway 42. The cutter piston 68 consists of an upper slide body portion 70 having an annular bore 72 extending therethrough from annular top surface 74 to allow necessary fluid passage. As shown also in FIG. 5, the piston 68 includes a sealing O-ring 76. The lower portion of cutter piston 68 is formed with a cutter collet 78 which functions in coaction with a funnel block 80 that is secured within cylindrical housing 34. The funnel block 80 consists of upper and lower inverted cone sectors 82 and 84 which join to form a restrictor hole 86.

Figure 5:
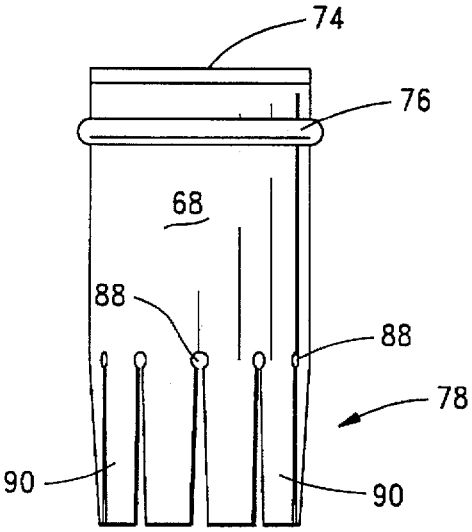
FIG. 5 is a view in elevation of the cutter piston and collet cutter of FIG. 2.
Figure 6:
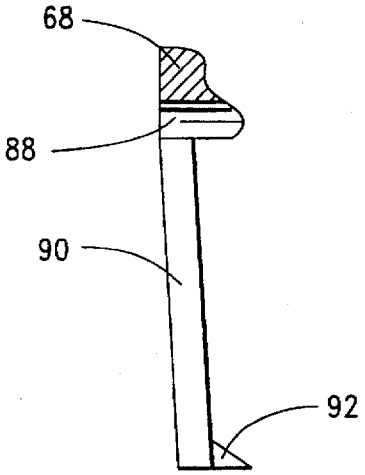
FIG. 6 is a showing in elevation and partial section of a collet cutter finger of FIG. 5.
Figure 7:
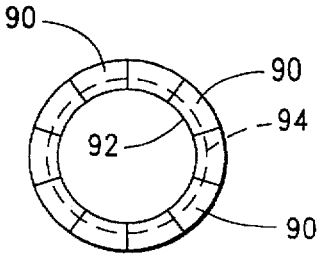
FIG. 7 is a bottom plan view of the collet cutter fingers in the closed position.

Referring to FIGS. 5 and 6, the collet cutter 78 is formed from a circumfery of spaced holes 88 formed radially through the sidewall of piston cutter 68, and a circumfery of collet fingers 90 are formed around the lower end of cutter piston 68. As shown in FIG. 6, each collet finger 90 formed adjacent a radial hole 88 of cutter piston 68 is formed with a slight inward angular bend, on the order of 4°, and the angle formed by adjacent edges of collet fingers 90 are also on the order of 4° taken so that the collet fingers 90 come together to define a diameter that is approximately equal to the inside diameter 94 (dash lines) of the fish tubing (see FIG. 7). As shown in FIG. 6, each of the collet fingers 90 has a blade 92 of hardened cutter material formed on the inside lower end thereby to provide a clean cut of the tubular material 94 within the closed diameter of collet fingers 90 and cutter blade 92 (as shown in FIG. 7) wherein the tubular member 94 is indicated.

In operation, the overshot cutter 10 is deployed preferably in situations where a coiled tubing drill string is hung up or snagged to expose a relatively small diameter fish object in the borehole. Thus, the overshot cutter 10 may be a two inch tubing tool or larger, as required, depending upon the size of the fish. The orifice plug 58 may be selected to have an axial orifice 50 that is some sub-multiple of the diameter of annular bore 14 so that a predetermined pressure increase can be realized across the drive piston 44. The burst disk 36 is selected to have a burst pressure exceeding the system operating pressure, e.g., 5000 psi.

The overshot cutter 10 is finally readied by securing the drive piston 44 with one or more selected shear pins 52 which serve to adjust the release point of drive piston 44, somewhere in the range of 2000 to 4000 applied psi. The overshot cutter 10 can then be run downhole as suspended via coiled tubing down to the vicinity of the problem fish whereupon the lower end 96 of the hydraulic cylinder 34 is lowered over the fish until requisite resistance is encountered. That is, the overshot cutter 10 is lowered as the fish upper end passes up through the restrictor hole 86 into the inner basket portion within cutter collet 78 and upward within annular bore 72 and inner barrel 66, if necessary.

When the overshot cutter 10 is deemed to be properly positioned, the operator at the surface increases applied pressure through the supporting tubing 18 to the top of drive piston 44, and when the shear pins 52 shear, drive piston 44 descends into contact with annular end surface 67 of inner barrel 66 as both elements continue descent contacting annular top surface 74 of cutter piston 70 thereby driving cutter piston 70 downward to drive collet fingers 90 into contact with cone sector 82. This functions to close the collet 78 as it progresses downward. The collet 78 then closes completely around the tubing fish until complete closure when it cuts the tubing to separation as shown in FIG. 7. With the tubing fish cut off, it is then retained within the basket interior of bore 72 and the closed collet 78 whereupon it may be withdrawn from the casing with entry of other tubing tools downhole to grasp the free end of the downhole tubing.

The foregoing discloses a simplified yet novel form of over-shot cutter tool that is particularly effective in operations dealing with coiled tubing problems. The overshot cutter tool is effective in performing a clean circular cut of coiled tubing that makes up a drill string so that problems of fish removal are readily effected. Once a fish has been located, cut and removed using the overshot cutter 10, the casing is clear for subsequent operations to re-attach and withdraw the lower tubing component and drill members.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. An overshot cutter for removing a fish from a wellbore, comprising:

an elongate housing having upper and lower ends;

means for suspending said housing in said wellbore with the lower end enveloping said fish;

a drive piston retained in said housing upper end by means of a shear pin;

a cutter piston slidably retained in said housing adjacent said lower end, said cutter piston extending a collet cutter therebelow;

a restrictor block defining a reducing orifice proximate the lower end of said housing; and hydraulic means for shearing said drive piston shear pin and forcing said drive piston down to force said cutter piston down around said fish while the restrictor block closes the collet cutter to separate the fish for retention within the cutter piston for subsequent removal.

2. An overshot cutter as set forth in claim 1 wherein said means for suspending comprises:

coiled tubing connected to suspend said housing in said wellbore.

3. An overshot cutter as set forth in claim 2 which further includes:

a connector sub having an axial bore for threadedly connecting said elongate housing to said coiled tubing.

4. An overshot cutter as set forth in claim 3 wherein said drive piston comprises:

a cylindrical piston having an axial bore; and an orifice plug secured in said axial bore to present a reduced orifice thereby to effect a reduced hydraulic pressure below said drive piston.

5. An overshot cutter as set forth in claim 4 which further includes:

an inner barrel disposed slidably in said housing between said drive piston and said cutter piston.

6. An overshot cutter for removing a fish from a wellbore comprising:

a cylindrical housing having upper and lower ends;

means for suspending said cylindrical housing in said wellbore with the lower end over said fish;

a drive piston slidable in said cylindrical housing and disposed near the upper end of said housing;

a shear pin locking said drive piston in said housing upper end;

an inner barrel slidable within said housing below said drive piston;

a cutter piston slidable in said housing below said inner barrel and extending a collet cutter below said cutter piston;

a restrictor block secured in said housing below said cutter piston; and means for hydraulically forcing said drive piston down shearing the shear pin and striking the inner barrel and cutter piston in succession thereby to drive the collet cutter through the restrictor block to effect cutting separation of the fish.

7. An overshot cutter as set forth in claim 6 wherein said means for suspending comprises:

coiled tubing; and a connector sub threadedly connecting said coiled tubing to said cylindrical housing.

8. An overshot cutter as set forth in claim 7 wherein said cutter piston and collet cutter comprise:

a cylindrical piston having upper and lower ends wherein the lower end extends a periphery of collet fingers each having a hardened cutter blade directed radially inward on the end of the fingers, said collet fingers being circumferentially spaced in tapered manner to allow closure of the cutter blades when the collet fingers are forced down through the restrictor block.

9. An overshot cutter as set forth in claim 1 wherein said cutter piston and collet cutter comprise:

a cylindrical piston having upper and lower ends wherein the lower end extends a periphery of collet fingers each having a hardened cutter blade directed radially inward on the end of the fingers, said collet fingers being circumferentially spaced in tapered manner to allow closure of the cutter blades when the collet fingers are forced down through the restrictor block.

* * * * *